US006993116B1

(12) United States Patent
Heidrich

(10) Patent No.: US 6,993,116 B1
(45) Date of Patent: Jan. 31, 2006

(54) METALLIC VACUUM HOUSING FOR AN X-RAY TUBE

(75) Inventor: Günter Heidrich, Gerhardshofen (DE)

(73) Assignee: Siemens Aktiengesellschaft, Munich (DE)

( * ) Notice: Subject to any disclaimer, the term of this patent is extended or adjusted under 35 U.S.C. 154(b) by 68 days.

(21) Appl. No.: 10/688,825

(22) Filed: Oct. 17, 2003

(51) Int. Cl.
*H01J 35/16* (2006.01)

(52) U.S. Cl. ..... 378/127; 378/121

(58) Field of Classification Search ..... 378/119, 378/121, 125, 127, 128, 136, 137, 138, 140, 378/141, 142, 193, 203
See application file for complete search history.

(56) References Cited

U.S. PATENT DOCUMENTS 3,591,821 A * 7/1971 Seki et al. ..... 378/125
3,892,989 A * 7/1975 Gralenski et al. ..... 378/138
H312 H * 7/1987 Parker ..... 378/127
4,943,989 A * 7/1990 Lounsberry et al. ..... 378/130
5,224,143 A * 6/1993 Dumitrescu et al. ..... 378/136
5,909,479 A 6/1999 Rother ..... 378/121
6,115,454 A * 9/2000 Andrews et al. ..... 378/140
6,134,299 A * 10/2000 Artig ..... 378/121
6,400,799 B1 * 6/2002 Andrews ..... 378/141
6,438,208 B1 * 8/2002 Koller ..... 378/140
6,594,341 B1 * 7/2003 Lu et al. ..... 378/140
6,819,741 B2 * 11/2004 Chidester ..... 378/136

* cited by examiner

*Primary Examiner*—Allen C. Ho
(74) *Attorney, Agent, or Firm*—Schiff Hardin LLP

(57) ABSTRACT

In an X-ray tube having a metallic vacuum housing containing an anode and a cathode which emits an electron beam proceeding from said cathode to said anode, the metallic vacuum housing is improved by providing several notches into the surface of the metallic vacuum housing.

8 Claims, 4 Drawing Sheets

METALLIC VACUUM HOUSING FOR AN X-RAY TUBE

BACKGROUND OF THE INVENTION

1. Field of the Invention

The invention relates to a metallic vacuum housing for an X-ray tube of the type having an anode and a cathode arranged inside the metallic vacuum housing.

2. Description of the Prior Art

An X-ray tube essentially has a cathode and an anode that are arranged in a vacuum-tight evacuated housing which substantially may be made out of a metallic material. The cathode emits, during operation of the X-ray tube, an electron beam that strikes the anode at an impact zone that usually is formed by a layer of a tungsten-rhenium alloy. When striking the anode, several electrons of the electron beam are decelerated and produce X-ray photons. Some of the electrons of the electronic beam, however, are scattered rather than decelerated. Scattered electrons may strike the surface of the vacuum housing. An X-ray tube with a metallic vacuum housing is, for instance, described in U.S. Pat. No. 5,909,479.

Scattered electrons striking the metallic vacuum housing may stress the housing thermally. The thermal stress can produce cracks in the metallic vacuum housing eventually causing a leakage of the vacuum housing. Failure of the X-ray tube because of a leakage of its metallic housing due to scattered electrons may be even more likely if scattered electrons preferentially strike a certain area of the vacuum housing.

SUMMARY OF THE INVENTION

It is an object of the present invention to provide a metallic vacuum housing for an X-ray tube wherein the negative effects of scattered electrons striking the metallic vacuum housing is at least alleviated.

This object of the present invention is achieved in an X-ray tube having a metallic vacuum housing containing an anode and a cathode which emits an electron beam proceeding from the cathode to the anode, wherein the metallic vacuum housing has several notches or grooves cut into the surface of the metallic vacuum housing.

The present invention is based on the recognition that notches or grooves, which are preferably cut into the inside surface of the metallic vacuum housing, allow the vacuum housing to expand locally when heated due to being struck by scattered electrons, and to contract. The notches or grooves may be cut with a laser and preferably are less than 0.5 mm or 0.3 mm deep.

The distance between two notches may be between 0.5 mm and 1 mm in a preferred embodiment of the invention.

Notches or grooves may also be differently shaped, such as lattice-shaped.

Depending on the geometry of the X-ray tube, and particularly depending on the geometry of the metallic vacuum housing and the location of the anode inside the vacuum housing, scattered electrons may be statistically more likely to strike certain areas of the housing's surface. The notches, therefore, may be located only where scattered electrons most likely strike the surface of the metallic vacuum housing.

In one embodiment of the invention, the metallic vacuum housing has a chamber containing the cathode, a volume containing the anode, and a shaft-shaped housing section, through which the electron beam proceeds from the cathode to the anode, connecting the chamber to the volume. Then the notches or grooves are preferably located around the connection of the shaft-shaped housing section and the volume.

DESCRIPTION OF THE PREFERRED EMBODIMENTS

Figure 1:
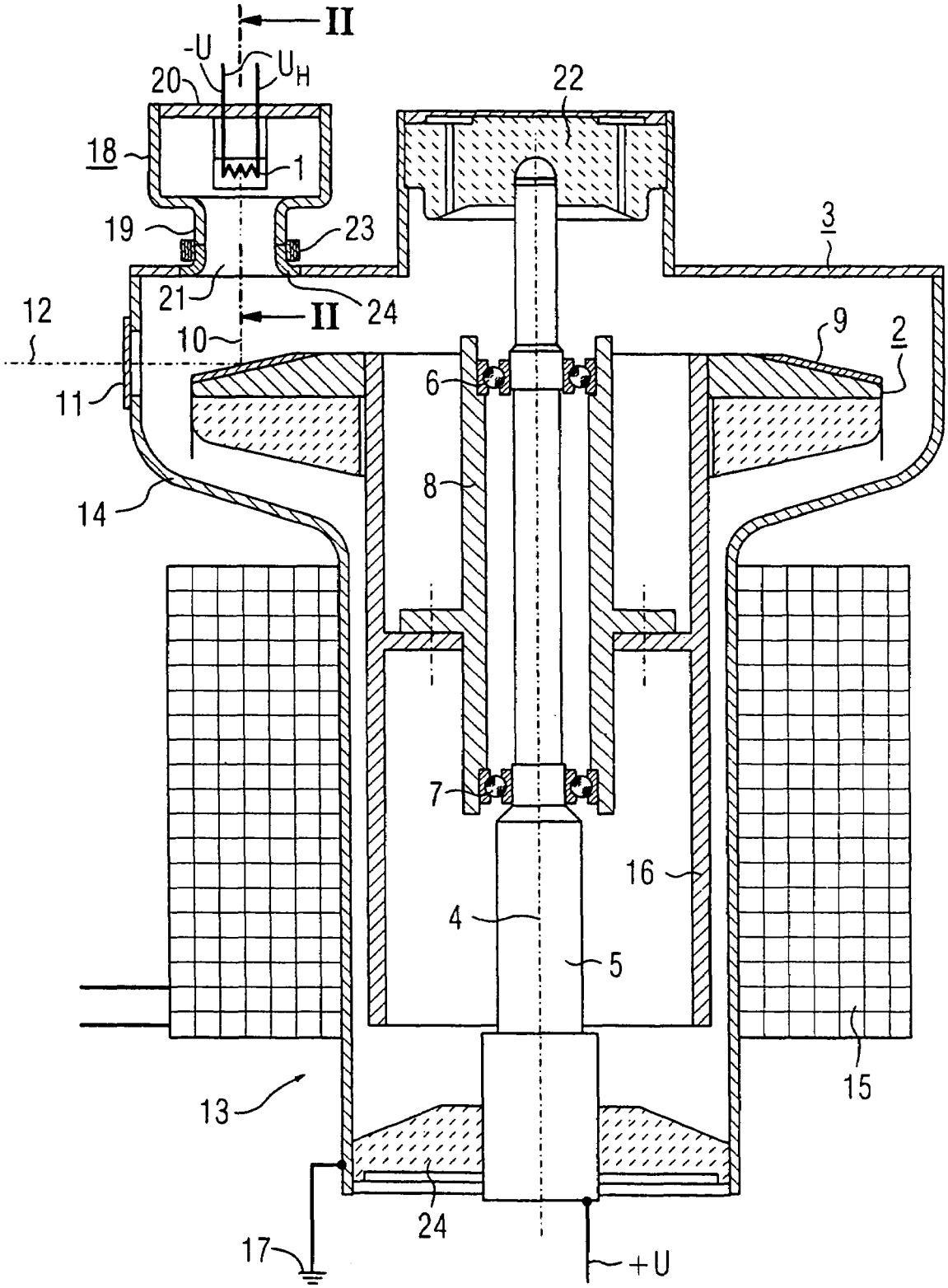
FIG. 1 shows an X-ray tube with a vacuum housing of the invention in longitudinal section.

The X-ray tube according to FIG. 1 has a fixed cathode 1 and a rotating anode, generally referred as 2, which are arranged in a vacuum-tight evacuated housing 3. The rotating anode 2 is rotatably seated on a fixed shaft 5 inside the vacuum housing 3 via two roller bearings 6 and 7 and a bearing sleeve 8.

The rotating anode 2 is rotationally symmetric relative to the center axis 4 of the shaft 5 and has an impact region 9 that is formed, in the exemplary embodiment, as a layer of a tungsten-rhenium alloy. During operation of the X-ray tube, an electron beam 10 originating from the cathode 1 strikes the impact region 9 of the rotating anode 2, in order to generate X-radiation (only the center axis of the electron beam 10 is shown in FIG. 1 as a broken line). The corresponding X-ray beam, the central ray 12 of which is depicted in FIG. 1, exits the vacuum housing 3 through a beam exit window 11 which is provided in the vacuum housing 3.

An electric motor, for instance a squirrel-cage motor 13 in the exemplary embodiment, rotates the rotating anode 2 during operation of the X-ray tube. The squirrel-cage motor 13 has a stator 15 slipped onto the vacuum housing 3 and a rotor 16 located inside the vacuum housing 3.

The vacuum housing 3 is made of a metallic material except for an insulator 20, which supports the cathode 1, and two insulators 22 and 24 which accept the shaft 5. The vacuum housing 3 has a region surrounding a space or volume 14 for the rotating anode 2. A chamber 18 for the cathode 1 is connected to the volume 14 via a shaft-shaped housing section 19. For the present exemplary embodiment, the cathode 1 is thus located in a special chamber 18 of the vacuum housing 3. Other embodiments of metallic housings are also within the scope of the invention.

The shaft 5 that is accepted vacuum-tight in the insulators 22 and 24 is set at a positive high-voltage +U for the rotating anode 2. As a result, the tube current flows via the roller bearings 6 and 7. As evident from the illustration depicted in FIG. 1, a negative high-voltage −U is set at one terminal of the cathode 1. Across the terminals of the cathode 1 lies the filament voltage $U_H$. The vacuum housing 3 is grounded as illustrated by the ground symbol 17. The voltages +U, −U and $U_H$ for the anode 2 and the cathode 1 are provided by suitable power supplies and electric cables generally known in the art (the power supplies and the electric cables are not shown in FIG. 1). Therefore, the exemplary X-ray tube according to FIG. 1 is a so-called two-pole X-ray tube.

During operation of the X-ray tube, the electron beam 10 that originates from the cathode 1 propagates through the shaft-shaped housing section 19 and strikes the rotating anode 2. As a result, the shaft-shaped housing section 19 limits a diaphragm aperture 21 whose dimensions are selected such that they do not significantly exceed the dimensions that are necessary for an unimpeded passage of the electron beam 10.

Figure 2:
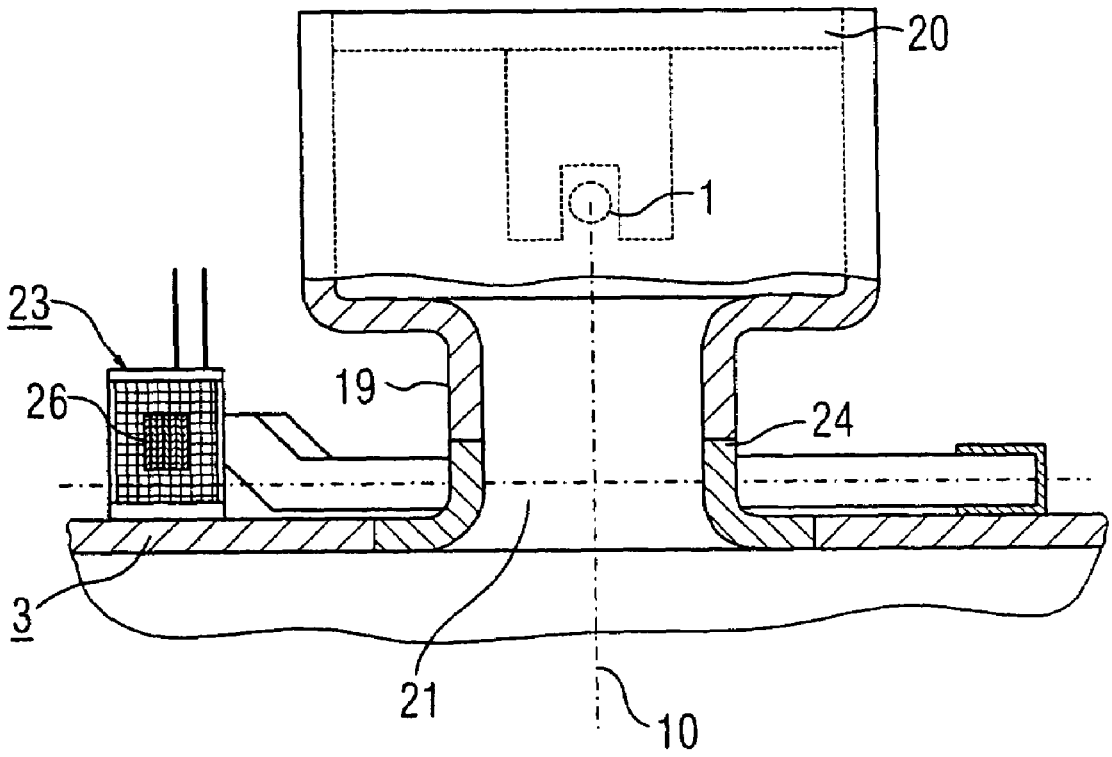
FIG. 2 shows a sectional view of a portion of the X-ray tube of FIG. 1 taken along the line II—II in FIG. 1.

At least the chamber 18, the shaft-shaped housing section 19, and the upper section of the volume 14 of the vacuum housing 3, and preferably all metallic parts of the vacuum housing 3, are made of non-magnetic materials, for instance stainless steel, and limit an annular space which is radially open to the exterior of the vacuum housing 3. An electromagnet 23 schematically indicated in FIGS. 1 and 2 is arranged around this space and generates a magnetic deflecting field for the electron beam 10 during operation of the X-ray tube. The magnetic deflecting field deflects the electron beam 10 perpendicularly to the plane of the drawing of FIG. 1.

The winding 26 of the electromagnet 23 forms in the present example a U-shaped yoke and has schematically indicated terminals which are connected to a current source (not shown in FIGS. 1 and 2), so that a current is applied to the windings 26 of the electromagnet 23 during operation of the X-ray tube. The current through the winding 26 is appropriately controlled for the desired deflection of the electron beam 10 by a suitable controller, as generally known in the art. The controller is not shown in FIGS. 1 and 2.

As described above, the electron beam 10 strikes the impact region 9 of the anode 2. As a result, electrons of the electron beam 10 are abruptly decelerated, producing X-rays. Some of the electrons of the electron beam 10, however, are rather scattered than decelerated by the anode 2. Scattered electrons are likely to strike the surface of the vacuum housing 3. In the exemplary embodiment, scattered electron most likely strike a region 24 of the vacuum housing 3. The region 24 of the vacuum housing 3 is located around the shaft-shaped housing section 19 next to the volume 14 of the vacuum housing 3 and the part of the volume 14 next to the shaft-shaped housing section 19, as illustrated in FIG. 2 which shows a sectional view of a portion of the X-ray tube of FIG. 1 taken along the line II—II in FIG. 1.

Since the vacuum housing 3 and especially the region 24 of the vacuum housing 3 is thermally stressed when struck by scattered electrons, the surface of the vacuum housing 3's region 24 directed inside the vacuum housing 3 comprises notches or grooves cut into its surface. In the exemplary embodiment, the notches or grooves are approximately 0.25 mm deep and were cut with a laser. The laser is not shown in the figures, because lasers suitable for cutting notches or grooves into the surface of a metallic object are well known in the art of material science.

Figure 3:
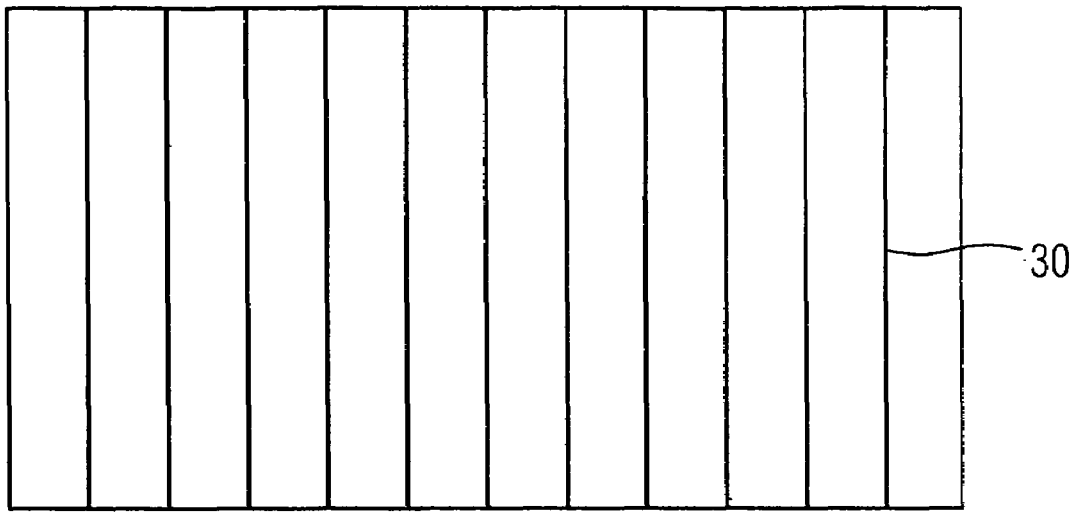
FIGS. 3 to 6 show pattern of notches cut into the surface of the vacuum housing of the X-ray tube of FIGS. 1 and 2.
Figure 4:
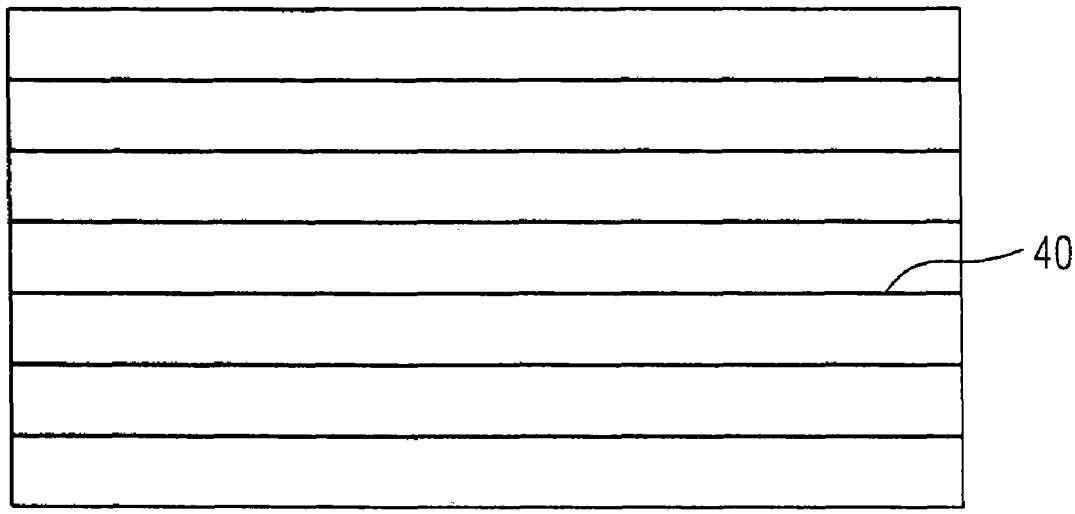
Figure 5:
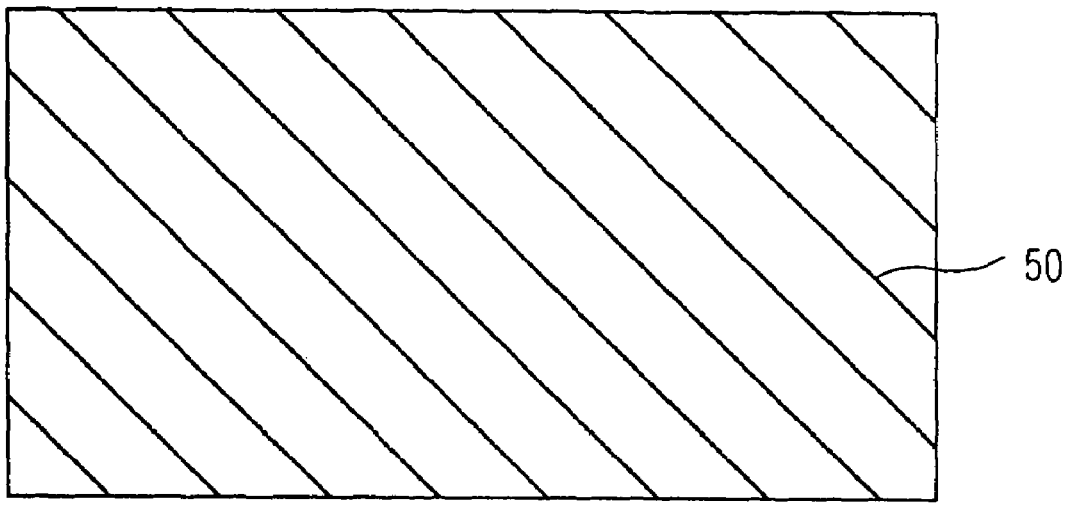
Figure 6:
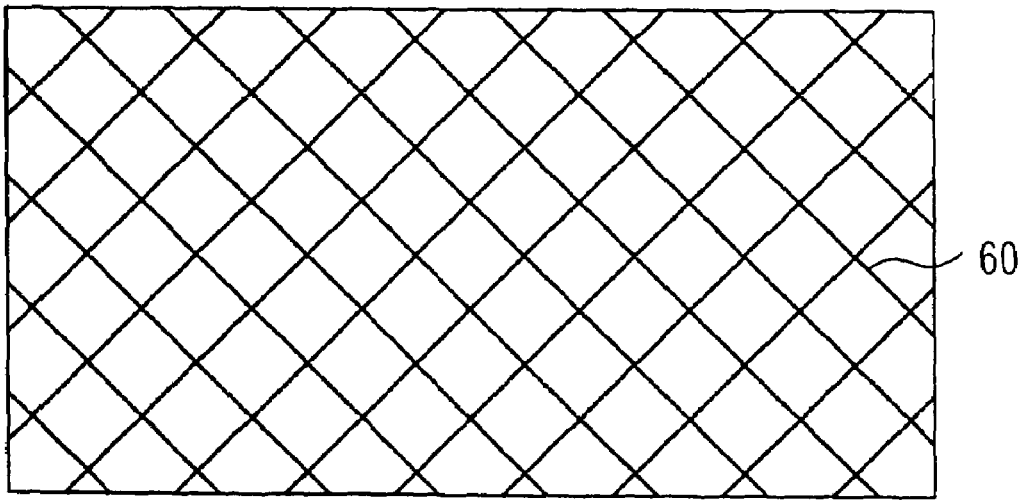

Particular suitable patterns for the notches or grooves cut into the vacuum housing 3 are shown in FIGS. 3 to 6 by way of example. The notches or grooves 30 depicted in FIG. 3 are parallel relative to the line II—II, the notches or grooves 40 shown in FIG. 4 are radially orientated relative to the line II—II, and the notches or grooves 50 depicted in FIG. 5 are beveled relative to the line II—II. Finally, the notches or grooves 60 shown in FIG. 6 have a lattice-like shape. In the present example, the distance between two notches or grooves shown in FIGS. 3 to 6 are approximately 0.75 mm.

Although modifications and changes may be suggested by those skilled in the art, it is the intention of the inventor to embody within the patent warranted hereon all changes and modifications as reasonably and properly come within the scope of his contribution to the art.

I claim as my invention:

1. An X-ray tube comprising:

a metallic vacuum housing containing an evacuated volume;

an anode disposed in said evacuated volume;

a cathode disposed in said evacuated volume, said cathode emitting an electron beam proceeding from said cathode to said anode; and said metallic vacuum housing having a surface facing, and defining a part of, said evacuated volume, said surface having a plurality of notches therein that relieve thermal stress in said surface caused by electrons back-scattered onto said surface from said electron beam striking said anode.

2. The improvement of claim 1, wherein said notches are less than 0.5 mm deep.

3. The improvement of claim 1, wherein said notches are less than 0.3 mm deep.

4. The improvement of claim 1, wherein the distance between two notches of said notches is between 0.5 mm and 1 mm.

5. The improvement of claim 1, wherein said notches are lattice-shaped.

6. The improvement of claim 1, wherein said notches are located where said back-scattered electrons most likely strike said metallic vacuum housing.

7. The improvement of claim 1, wherein said metallic vacuum housing comprises a chamber containing said cathode, a volume containing said anode, and a shaft-shaped housing section, through which said electron beam proceeds from said cathode to said anode, connecting said chamber to said volume, said evacuated volume comprising an interior of said chamber, said volume containing said anode, and an interior of said shaft-shaped housing section.

8. The improvement of claim 7, wherein said notches are located around a region where said shaft-shaped housing section meets said volume.

* * * * *